US005327822A

United States Patent [19]

Koenig

[11] Patent Number: 5,327,822

[45] Date of Patent: Jul. 12, 1994

[54] APPARATUS FOR CRUSHING ARTICLES

[76] Inventor: Richard M. Koenig, 604 E. Lakeview Dr., Whitefish Bay, Wis. 53217

[21] Appl. No.: 949,896

[22] Filed: Sep. 23, 1992

[51] Int. Cl.[5] ..... B30B 15/30; B30B 9/32

[52] U.S. Cl. ..... 100/45; 100/137; 100/216; 100/218; 100/902

[58] Field of Search ..... 100/45, 137, 215, 216, 100/218, 245, 902

[56] References Cited

U.S. PATENT DOCUMENTS

| | | | |
|---|---|---|---|
| 2,522,800 | 9/1950 | Quiroz | 100/215 X |
| 3,817,169 | 6/1974 | Bischoff | 100/902 X |
| 3,857,334 | 12/1974 | Arp | 100/902 X |
| 4,213,384 | 7/1980 | Telling | 100/215 X |
| 4,216,713 | 8/1980 | Jung | 100/216 X |
| 4,291,618 | 9/1981 | Heiser et al. | 100/216 X |
| 4,324,325 | 4/1982 | Dewoolfson | 100/902 X |
| 4,436,026 | 3/1984 | Imamura et al. | 100/902 X |
| 4,469,212 | 9/1984 | Dewoolfson et al. | 100/902 X |
| 4,489,649 | 12/1984 | Daugherty | 100/902 X |
| 4,821,969 | 4/1989 | Fox et al. | 100/902 X |
| 4,953,682 | 9/1990 | Helbawi | 100/902 X |
| 5,010,810 | 4/1991 | DeLorme | 100/902 X |
| 5,103,721 | 4/1992 | Chou et al. | 100/902 X |
| 5,111,927 | 5/1992 | Schulze, Jr. | 100/902 X |
| 5,121,685 | 6/1992 | Turner | 100/137 X |
| 5,251,546 | 10/1993 | Wergeland | 100/902 X |

FOREIGN PATENT DOCUMENTS

| | | | |
|---|---|---|---|
| 1392203 | 2/1965 | France | 100/902 |
| 52-8683 | 1/1977 | Japan | 100/902 |
| 58-145398 | 8/1983 | Japan | 100/902 |

*Primary Examiner*—Stephen F. Gerrity

*Attorney, Agent, or Firm*—Andrus, Sceales, Starke & Sawall

[57] ABSTRACT

An apparatus for crushing articles such as metal cans. A fixed anvil is mounted on a frame and a ram is mounted for movement in a direction toward and away from the anvil to crush an article located therebetween. The articles are fed sequentially to the crushing zone between the anvil and the ram through a vertical chute. A spring loaded wedge plate extends outwardly from the ram toward the anvil and initially contacts the article intermediate its length to bend or deform the article to thereby insure uniform crushing of the article by the ram.

10 Claims, 3 Drawing Sheets

FIG. 5
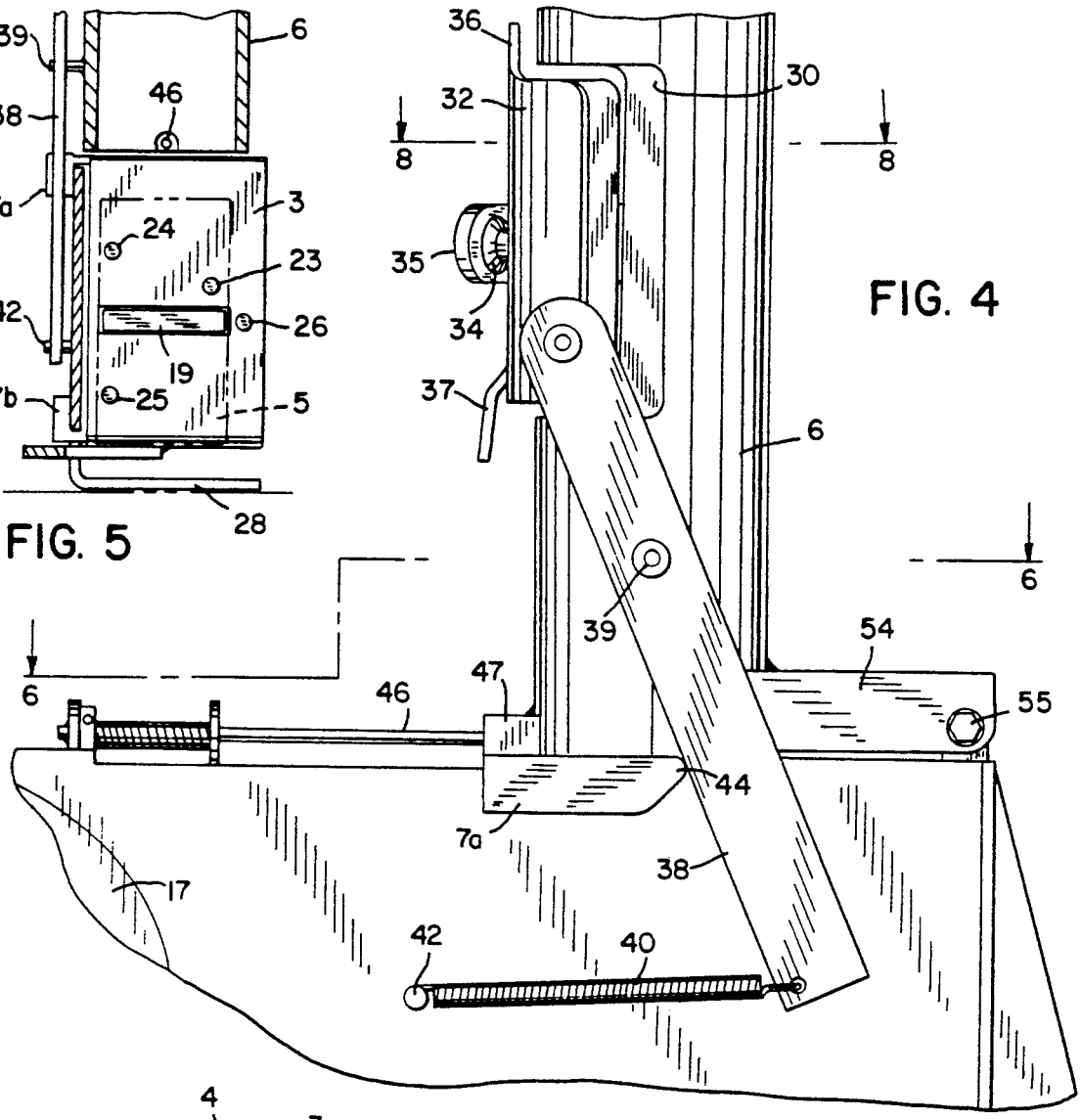
FIG. 4
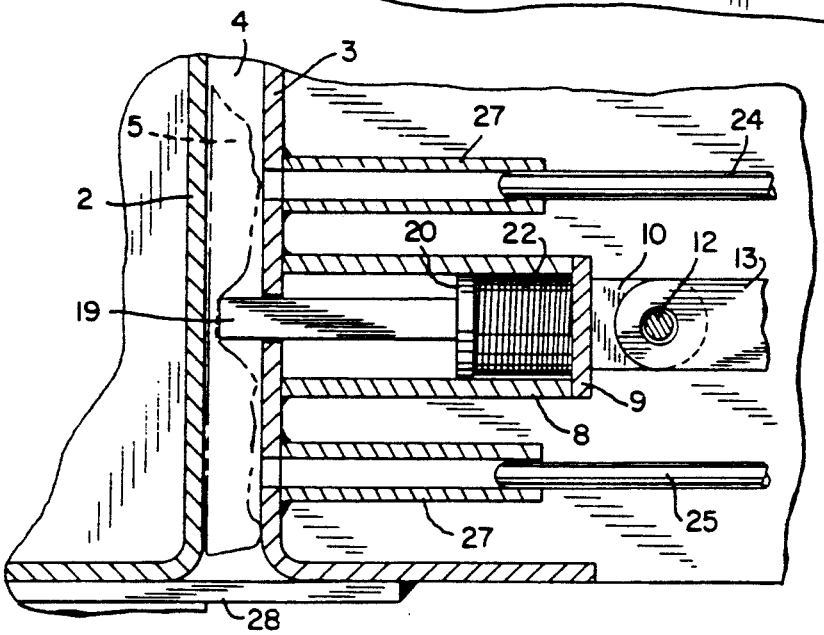
FIG. 3

APPARATUS FOR CRUSHING ARTICLES

BACKGROUND OF THE INVENTION

In recent years there has been increased emphasis on energy and material conservation and, as a result, the crushing and recycling of aluminum beverage containers has become an important factor in the recycling effort. In order to recycle used beverage cans, it has been the practice to initially crush or compact the cans to reduce the volume and reduce transportation charges.

Many types of devices have been used in the past for crushing aluminum beverage cans. Small, manually operated crushers have been used by homeowners, in which the cans are individually crushed through operation of a manual handle or lever. For establishments that generate a large number of cans, such as restaurants, bars, and the like, power-operated can crushing devices have been utilized. In addition, large-sized commercial crushers have been used which are intended to receive cans from the public and not only crush the cans, but also can dispense either money or tokens in accordance with the weight of the cans deposited.

There has been a need for an inexpensive, compact, automatic can crusher, that could be used in establishments that handle a considerable quantity of beverage cans, such as restaurants, bars, fast food establishments, and the like.

SUMMARY OF THE INVENTION

The invention is directed to an apparatus for crushing articles and has particle application for crushing metal beverage cans, such as beer or soft drink cans.

In accordance with the invention, a fixed anvil or support is secured to a frame, and a ram is mounted for movement in a direction toward and away from the anvil to thereby crush an article located in the crushing zone between the anvil and the ram.

A train or series of end-to-end cans are fed sequentially to the crushing zone through a vertical chute, and a movable stop is located at the bottom of the chute and is disposed to support the lowermost can in the train while a previously fed can is being crushed in the crushing zone. The can being crushed is supported in the crushing zone by a movable support plate.

Both the stop and the support plate are operably connected to the ram so that as the ram is moved toward the anvil in the crushing stroke, the stop will be moved to the supporting position in the chute and the support plate will similarly be moved to a supporting position in the crushing zone to support the can being crushed. As the ram is moved away from the anvil in the return stroke, the support plate will move to a nonobstructing position to enable the crushed can to fall from the crushing zone, and simultaneously the stop will also move to a nonobstructing position to permit the can that was supported on the stop to fall from the chute to the crushing zone.

The chute is provided with an opening or window which is enclosed by a movable door that is adapted to engage the lowermost can in the train of cans in the chute. The door is also operably connected to the ram and is moved to a release position as the ram moves in the crushing stroke to thereby permit the lowermost can of the train to fall downwardly in position to engage the stop at the lower end of the chute. This construction enables only a single can to be discharged at a time from the chute to the crushing zone.

As a feature of the invention, a spring loaded wedge plate extends outwardly from the ram in a direction toward the anvil. As the ram moves in the crushing stroke, the wedge plate will initially engage the can at a location midway between its ends to thereby bend or deform the can. As the ram completes its crushing stroke, the wedge plate will move inwardly against the force of the spring and the deformed can will be uniformly compacted or crushed.

A series of fixed ejector pins are mounted on the frame and project into the crushing zone. As the ram moves in its return stroke, the crushed can, if hanging up on the ram, will engage the ejector pins to strip the can from the ram and permit the crushed can to fall downwardly into a suitable disposal container.

The apparatus of the invention provides more uniform crushing or compaction of the cans or other articles. The ram moves transversely of the axis of the can and the spring loaded wedge plate initially bends the can to provide uniform crushing.

The apparatus is capable of handling cans or articles of various lengths and diameters. The train of end-to-end cans is securely held within the chute by the pivotable door which extends through the opening in the chute.

It is contemplated that the apparatus can also be used to crush plastic bottles, or other articles, in addition to metal cans.

Other objects and advantages will appear in the course of the following description.

DESCRIPTION OF THE DRAWINGS

The drawings illustrate the best mode presently contemplated of carrying out the invention.

In the drawings:

FIG. 3 is an enlarged fragmentary vertical section of the ram in the crushing position;

FIG. 4 is a fragmentary rear elevation of the apparatus;

FIG. 5 is a section taken along line 5—5 of FIG. 1;

DESCRIPTION OF THE ILLUSTRATED EMBODIMENT

Figure 1:
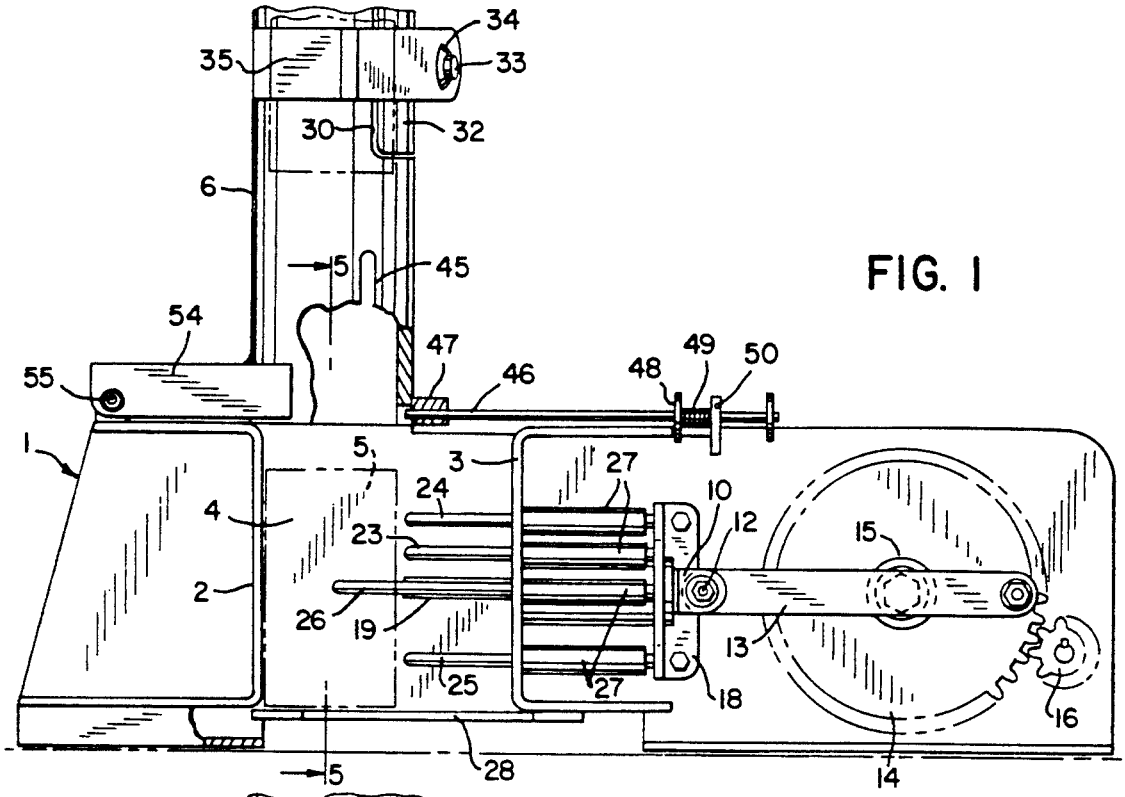
FIG. 1 is a front elevation of the can crushing apparatus of the invention, with parts broken away, and showing the ram in the retracted position.

The drawings illustrate an apparatus for crushing articles such as metal cans, bottles or the like. The apparatus includes a frame 1 which takes the form of a vertical plate and a channel shaped anvil 2 is secured to one surface of the plate 1.

Mounted for movement on plate 1 in a direction toward and away from anvil 2 is a channel shaped ram 3 and the space between anvil 2 and ram 3 defines a crushing zone 4. A can 5 or other article to be crushed is fed to the crushing zone 4 through a generally vertical tubular chute 6.

To guide the ram 3 in movement toward and away from anvil 2, channel-shaped guide brackets 7*a* and 7*b* are secured to the upper and lower edges of the ram and ride on the upper and lower edges respectively of plate 1, as shown in FIG. 5.

Mounted on the rear surface of ram 3 is a cylinder 8 and the closed rear end 9 of the cylinder carries a pair of lugs 10 which are pivotally connected by pin 12 to the end of a crank arm or connecting rod 13, as best shown in FIG. 3. The opposite end of crank arm 13 is pivotally connected to the peripheral edge portion of a sprocket 14 which is mounted for rotation on shaft 15 that projects outwardly from plate 1. Sprocket 14 can be driven in any desired manner, and as shown, a drive gear 16 is engaged with the sprocket and gear 16 is driven by a motor and speed reducing unit 17 which is mounted on the opposite side of plate 1 and is connected to the shaft of gear 16. Operation of motor and speed reducing unit 17 acting through the connecting rod 13 will move the ram 3 in an inward crushing stroke and an outer return stroke.

Figure 7:
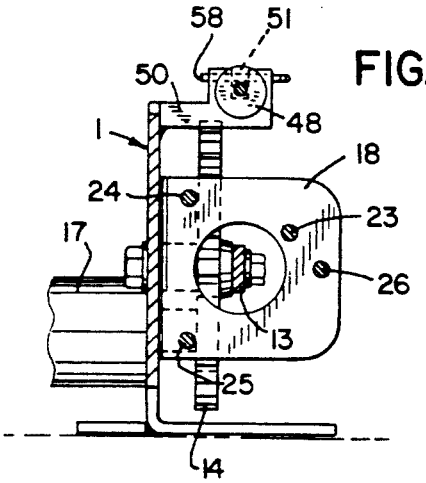
FIG. 7 is a section taken along line 7—7 of FIG. 6.

As best seen in FIG. 7, an L-shaped bracket 18 is secured to the plate 1 and is provided with a central opening which receives the connecting rod 13.

Extending outwardly from ram 3 toward anvil 2 is a spring loaded wedge plate 19. The inner end of plate 19 is secured to a plunger 20 which is mounted for sliding movement within the cylinder 8 (See FIG. 3). Wedge plate 19 is biased outwardly away from ram 3 by a compression spring 22 which is located within cylinder 8 and is interposed between cylinder end 9 and plunger 20.

The cans 5 are sequentially fed to crushing zone 4 through vertical chute 6 so that the axis of the can in the crushing zone 4 extends vertically as shown in FIG. 1. As ram 3 moves toward anvil 2 in the crushing stroke, the spring loaded wedge plate 19 will initially engage the can 5 approximately midway between the can ends to thereby bent or deform the can and draw the can ends inwardly. Continued movement of the ram in the crushing stroke will then force the wedge plate inwardly against the force of spring 22 and the ram will crush the can against the fixed anvil 2.

To aid in stripping the crushed can from the ram 3, a series of ejector pins 23–26 are mounted in fixed relation in the crushing zone 4. The inner ends of pins 23–26 are connected to the bracket 18 and the pins are mounted for sliding movement in sleeves 27 which are secured to the rear face of ram 3. As the ram moves in the return stroke, in a direction away from anvil 2, the crushed can 5, if it adheres to the face of the ram, will be stripped from the ram by the pins 23–26. As shown in FIG. 7, the pins are positioned at various locations in the crushing zone 4 and are strategically located to strip different size cans from the ram and insure that the stripped cans will fall downwardly to the collection site beneath the crushing zone.

The can 5 being crushed in the crushing zone 4 is supported on a support plate 28 which moves with the ram 3. Support plate 28 is positioned such that it will support a can 5 in the crushing zone, as the can is fed from chute 6 and as the ram moves inwardly in the crushing stroke. As the ram moves in the return stroke, support plate 28 will be correspondingly moved to a nonobstructing position where the crushed can fall by gravity from the crushing zone to a receptacle located beneath the crushing zone.

Figure 8:
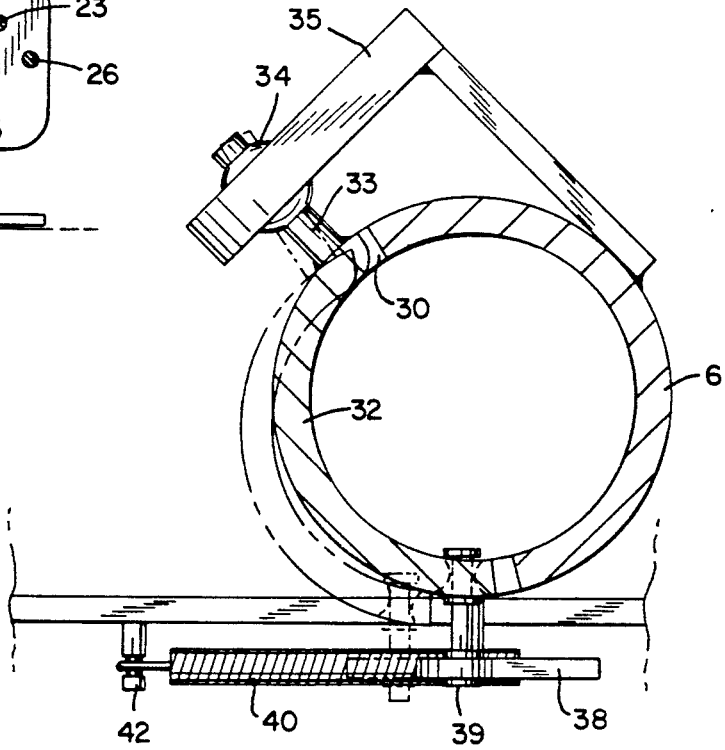
FIG. 8 is a section taken along line 8—8 of FIG. 4.

Cans 5 are in an end-to-end relation or train within the chute 6. The chute 6 is formed with an opening or window 30 which is enclosed by a movable door 32 that is movable between an inner supporting position where the door will engage the lowermost can in the train to a release position where the door is out of contact with the can. As seen in FIG. 8, the door is carried by a shaft 33 and the shaft in turn is mounted for universal movement by spherical bearing 34 with relation to an fixed L-shaped bracket 35. One end of the bracket is secured to the outer surface of chute 6. Stops 36 and 37 are connected to the upper and lower edges respectively of door 32, as seen in FIG. 4, and limit the inward movement of the door relative to the window 30 in chute 5.

Door 32 is biased to the inner supporting position by a spring loaded arm 38. The upper end of arm 38 is connected to the lower edge of door 32 while the central portion of the arm is pivoted to the chute 6 at pivot 39, as illustrated in FIG. 4. One end of an extension spring 40 is connected to the lower end of arm 38, while the opposite end of the spring is secured to a pin 42 which projects outwardly from the back side of plate 1. With this construction, the force of spring 40 will urge the door 32 inwardly against the lowermost can in the train to prevent the train of cans from falling downwardly within the chute.

The door 32 is moved to the release position by guide bracket *7a*. which is connected to ram 3 and is mounted for sliding movement on the upper edge of plate 1. The end 44 of bracket *7a* is adapted to engage the arm 8 as the ram moves forward in the crushing stroke, thus pivoting the arm 38 counterclockwise, as shown in FIG. 4 and moving door 32 to the open position to enable the bottom can in the train to fall downwardly within the chute.

The lower end of chute 6 is provided with an access slot 45.

Figure 2:
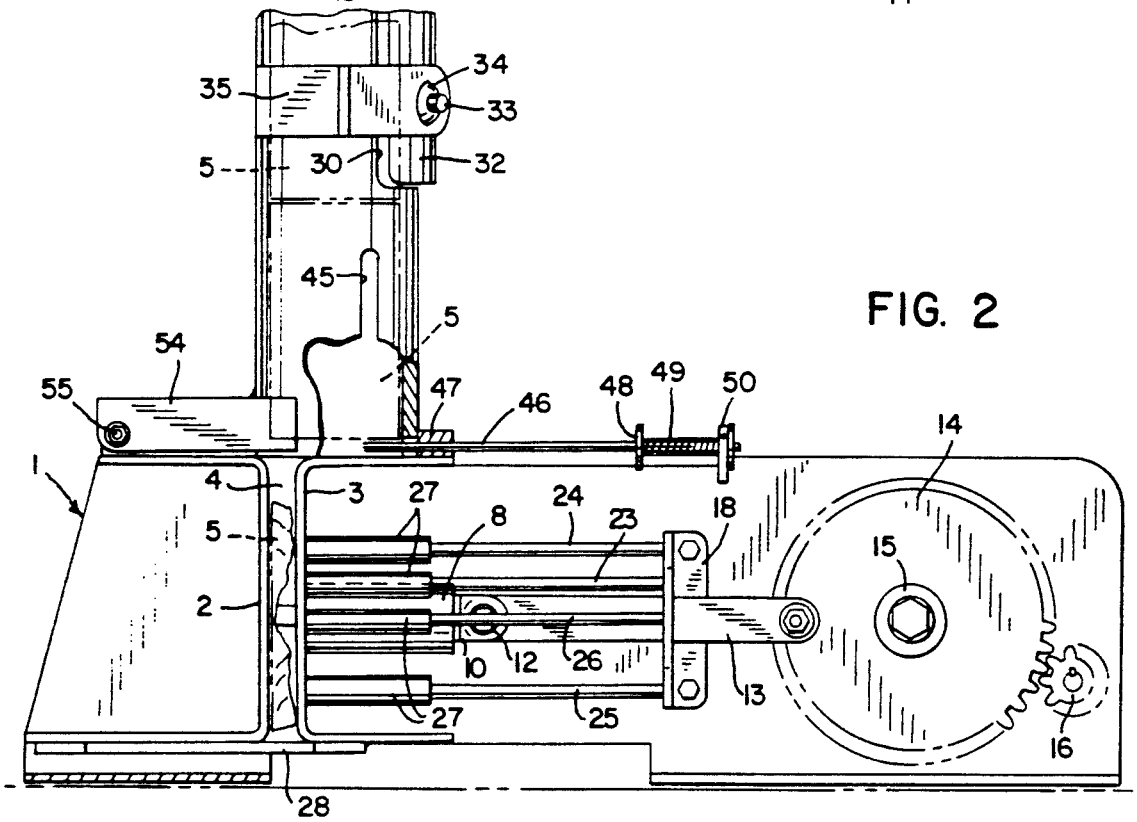
FIG. 2 is a view similar to FIG. 1 and showing the ram in the crushing position.
Figure 6:
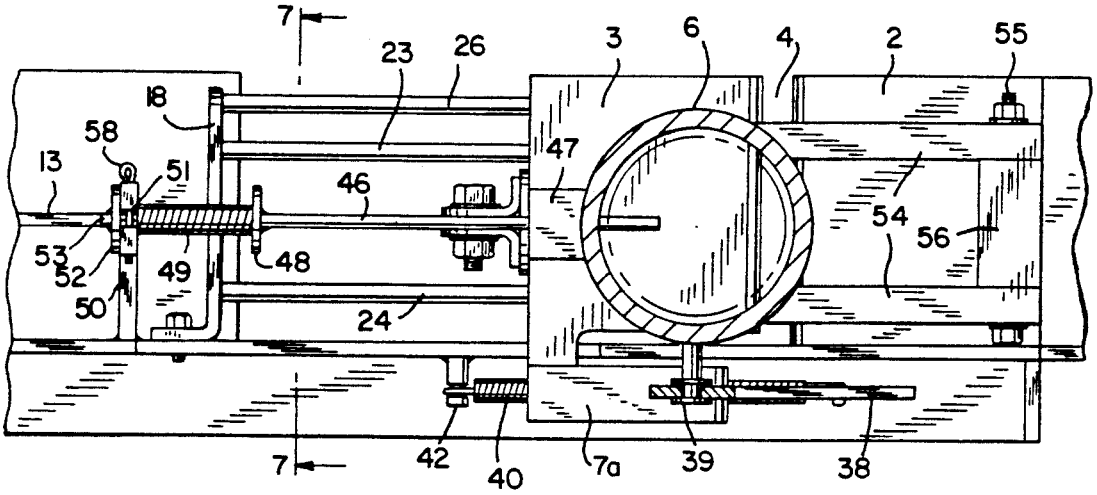
FIG. 6 is a section taken along line 6—6 of FIG. 4.

A stop is positioned at the lower end of chute 6 and serves to prevent the can 5 that was released by the door 32 from falling downwardly into the crushing zone 4. The stop takes the form of a reciprocating rod 46 which is mounted for sliding movement within a block 47 attached to the outer surface of chute 6. In its holding or obstructing position, as seen in FIG. 2, the inner end of rod 46 projects into the lower end of chute 6.

The rod 46 is operably connected to ram 3 and in this regard a disc 48 is secured to the midpoint of the length of the rod and has a diameter such that the lower edge of the disc will be engaged by the upper edge of the ram as the ram moves in the return stroke. A spring 49 is interposed between disk 48 and a fixed bracket 50 which is mounted on plate 1.

The outer end of rod 46 extends through a notch 51 in bracket 50 and the outer end of the rod carries a washer 52 and a threaded nut 53.

With this construction, movement of ram 3 in the return stroke will cause the rear edge of the ram to engage disc 48, thereby retracting the rod 46 from chute 6 against the force of spring 49 to enable the can 6 being held in the lower end of the chute to fall downwardly by gravity into the crushing zone 4 where it will be held by the support plate 28. When ram 3 moves in the next crushing stroke, the ram will move out of engagement with disc 48, enabling spring 49 to urge rod 46 inwardly to the obstructing position, where the rod will hold the can which had been previously released by opening of door 32.

As a feature of the invention, the chute 6 can be mounted for pivotal movement relative to the plate 1. In this regard, a pair of arms 54 extend outwardly in parallel relation from the lower end of chute 6 and the outer ends of the arms are pivoted by shaft 55 to cross member 56.

Rod 46 is maintained within the notch 51 by a cotter pin 58 which is inserted within openings in the bracket 50 and bridges the notch 51. By removal of cotter pin 58, chute 6 along with rod 46 can be pivoted relative to plate 1 to thereby permit access to the lower end of chute 6.

The ram 3 is shown in the fully retracted position in FIG. 1. In this retracted position, the rod stop 46 has been moved outwardly of the chute 6 to permit the can 5 that was held by the rod in chute 6 to fall into the crushing zone 4. The support plate 28 is at a position where it will permit the previously crushed can to fall by gravity from the crushing zone 4 but will support the uncrushed can being fed from the chute 6.

In the fully retracted position of the ram 3, spring 40 biases the door 32 to the closed position and into engagement with the lowermost can in the train to prevent the train of cans from falling to the crushing zone 4 as the rod 46 is also in the retracted position.

As the ram 3 moves forwardly in the crushing stroke, spring 49 will move the rod 46 inwardly to the supporting position in chute 6 and simultaneously the door 32 will be moved to the release position to permit the train of cans in the chute to fall downwardly where the lowermost can will then be supported on the rod 46.

Simultaneously, as the ram moves forwardly, the wedge plate 19 will engage the midpoint of the can 5, deforming the can and causing the can ends to be pivoted inwardly. Continued inward movement of the ram will move the wedge plate 19 inwardly against the force of spring 22 and cause the can to be crushed between the ram 3 and anvil 2.

As the ram moves outwardly in the return stroke, support plate 28 moves along with the ram to a non-obstructing position to enable the crushed can to fall by gravity from the crushing zone 4 to a receptacle or other disposal site. If the crushed can should hang up on the ram, it will be stripped from the ram by the ejector pins 23–26.

Outward movement of the ram in the return stroke will also move the door 32 to the closed position to engage and hold the second lowermost can in the train, while simultaneously moving the rod 46 to the retracted position to enable the lowermost can to fall by gravity into the crushing zone.

The invention provides a simple, yet effective apparatus for crushing articles, such as beverage cans or bottles and has particular use in restaurants, or bars, and the like, where the articles are fed through a vertical chute to the crushing apparatus.

The articles are crushed by a force operating transverse to the axis of the can, and the spring loaded wedge plate 19 initially deforms the can and aids in providing uniform compaction for the cans regardless of the axially length or diameter.

Various modes of carrying out the invention are contemplated as being within the scope of the following claims particularly pointing out and distinctly claiming the subject matter which is regarded as the invention.

I claim:

1. An apparatus for crushing articles, comprising a frame, a fixed anvil mounted on the frame, a ram mounted for movement on the frame in a direction toward and away from said anvil to crush an article located in a crushing zone between said anvil and said ram, drive means for moving said ram in a direction toward and away from said anvil, chute means to support a stack of articles in end-to-end vertically superimposed relation, said stack including a lowermost article and a second lowermost article, stack control means engaged with the second lowermost article in the stack and movable between an engaging position where said stack control means engages said second lowermost article and a release position, retaining means disposed in said chute means beneath said stack control means and disposed to support the lowermost article in the stack, said retaining means movable between an article supporting position and a release position, means responsive to movement of the ram in a direction away from said anvil for moving said retaining means to the release position, means responsive to movement of the ram in a direction away from said anvil for moving said stack control means to the engaging position, and means responsive to movement of the ram in a direction toward the anvil for moving said stack control means to the release position, said chute means being provided with an opening and said stack control means comprising a door movable in said opening between said engaging and said release positions.

2. The apparatus of claim 1, wherein said means responsive to movement of said ram in a direction toward the anvil to move the stack control means to the release position comprises an arm connected to the door and pivoted with respect to said frame, and an actuator on said ram to engage and pivot said arm.

3. The apparatus of claim 2, wherein said means responsive to movement of said ram in a direction away from said anvil to move the stack control means to the engaged position comprises a resilient member connected to the arm to bias the door inwardly against said second lowermost article.

4. The apparatus of claim 1, wherein said opening extends circumferentially of said chute means through an arc and said door is arcuate in horizontal cross section.

5. The apparatus of claim 1, and including means for mounting said chute means for pivotal movement relative to said frame.

6. An apparatus for crushing an article having a generally cylindrical side wall and a pair of opposed end walls, comprising a supporting frame, a fixed anvil mounted on the frame, a ram spaced from the anvil to provide a crushing zone therebetween and movable in a direction toward and away from said anvil to crush an article in the crushing zone, a chute to contain an article and having a lower end communicating with said crushing zone, feeding means for feeding an article from the chute to the crushing zone, drive means for moving the ram in a direction toward said anvil to crush the article in the crushing zone and for moving the ram in a direction away from said anvil, contacting means connected to the ram and projecting outwardly from the ram toward said anvil, said contacting means disposed to initially engage the side wall of the article prior to engagement of said article by said ram, biasing means for biasing said contacting means outwardly from said ram in a direction toward said anvil, said contacting means being moved inwardly against the force of said biasing means as said article is crushed by said ram, and stripping means disposed in the crushing zone and disposed to be engaged by a crushed article to prevent said article from adhering to said ram as the ram moves in the direction away from said anvil, said stripping means being mounted in fixed relation to said supporting frame and being mounted for movement in an opening in said ram.

7. The apparatus of claim 6, wherein said contacting means comprises a flat horizontal plate.

8. An apparatus for crushing articles, comprising a frame, a fixed anvil mounted on the frame, a ram mounted for movement on the frame in a direction toward and away from said anvil to crush an article located in a rushing zone between said anvil and said ram, drive means for moving said ram in a direction toward and away from said anvil, chute means to support a stack of articles in end-to-end relation, said stack including a lowermost article and a second lowermost article, stack control means engaged with the second lowermost article in the stack and movable between an engaging position where said stack control means engages said second lowermost article and a release position, retaining means disposed in said chute means beneath said stack control means and disposed to support the lowermost article in the stack, said retaining means movable between an article supporting position and a release position, means responsive to movement of the ram in a direction away from said anvil for moving said retaining means to the release position, means responsive to movement of the ram in a direction away from said anvil for moving said stack control means to the engaging position, means responsive to movement of the ramp in a direction toward the anvil for moving said stack control means to the release position, article support means disposed at the lower end of said crushing zone and mounted for movement between an article supporting position and a release position, and means responsive to movement of said ram in a direction away from said anvil for moving said article supporting means to the release position to thereby enable a crushed article to be discharged from said crushing zone.

9. The apparatus of claim 8, wherein each article comprises a can having a longitudinal axis, said article support means is constructed to support a can with the axis of the can disposed normal to the direction of movement of the ram.

10. An apparatus for crushing articles, comprising a frame, a fixed anvil mounted on the frame, a ram mounted for movement on the frame in a direction toward and away from said anvil to crush an article located in a crushing zone between said anvil and said ram, drive means for moving said ram in a direction toward and away from said anvil, chute means to support a stack of articles in end-to-end relation, said stack including a lowermost article and a second lowermost article, stack control means engaged with the second lowermost article in the stack and movable between an engaging position where said stack control means engages said second lowermost article and a release position, retaining means disposed in said chute means beneath said stack control means and disposed to support the lowermost article in the stack, said retaining means movable between an article supporting position and a release position, means responsive to movement of the ram in a direction away from said anvil for moving said retaining means to the release position, means responsive to movement of the ram in a direction away from said anvil for moving said stack control means to the engaging position, means responsive to movement of the ramp in a direction toward the anvil for moving said stack control means to the release position, wedge means connected to the ram and projecting outwardly from the ram toward said anvil for initially engaging and deforming said article prior to engagement of said article by said ram, and biasing means for biasing said wedge means outwardly from said ram, said wedge means being moved inwardly against the force of said biasing means as said article is crushed by said ram.

* * * * *

UNITED STATES PATENT AND TRADEMARK OFFICE

CERTIFICATE OF CORRECTION

PATENT NO. : 5,327,822

DATED : July 12, 1994

INVENTOR(S) : Richard M. Koenig

It is certified that error appears in the above-indentified patent and that said Letters Patent is hereby corrected as shown below:

Col. 6, line 16, claim 6, after "article" insert --intermediate the ends and deform said article--.

Col. 7, line 9, claim 8, cancel "rushing" and substitute therefor --crushing--.

Signed and Sealed this

Twenty-seventh Day of December, 1994

*Attest:*

*Attesting Officer*

BRUCE LEHMAN

*Commissioner of Patents and Trademarks*